US008025291B2

(12) United States Patent
Cote et al.

(10) Patent No.: US 8,025,291 B2
(45) Date of Patent: Sep. 27, 2011

(54) SIGNATURE VELOCITY REDUCTION DEVICE AND METHOD

(75) Inventors: Kevin Lauren Cote, Durham, NH (US); Lothar John Schroeder, Portsmouth, NH (US); Joseph Adrian St.Ours, Lee, NH (US)

(73) Assignee: Goss International America, Inc., Durham, NH (US)

( * ) Notice: Subject to any disclaimer, the term of this patent is extended or adjusted under 35 U.S.C. 154(b) by 765 days.

(21) Appl. No.: 11/328,835

(22) Filed: Jan. 10, 2006

(65) Prior Publication Data

US 2007/0158903 A1 Jul. 12, 2007

(51) Int. Cl.
*B65H 5/34* (2006.01)

(52) U.S. Cl. ..... 271/270; 271/203

(58) Field of Classification Search ..... 271/202, 271/203, 270; 198/461.1, 461.3, 415
See application file for complete search history.

(56) References Cited

U.S. PATENT DOCUMENTS 3,861,672 A * 1/1975 Norton ..... 271/203
4,506,873 A * 3/1985 Faltin ..... 270/46
4,601,387 A * 7/1986 Kobler ..... 198/626.1
5,452,886 A * 9/1995 Cote et al. ..... 271/270
5,560,599 A * 10/1996 Curley et al. ..... 271/270
5,794,929 A * 8/1998 Curley et al. ..... 271/270
5,803,450 A 9/1998 Brokate et al.
6,585,262 B2 * 7/2003 Nakanishi ..... 271/270
6,675,713 B2 1/2004 Zeltner
2002/0124749 A1 9/2002 Zeltner

* cited by examiner

*Primary Examiner* — Michael McCullough
(74) *Attorney, Agent, or Firm* — Davidson, Davidson & Kappel, LLC

(57) ABSTRACT

An apparatus for decelerating a signature comprises a movable belt arrangement, and a motor coupled to the movable belt arrangement for controllably moving the movable belt arrangement through a cyclical velocity profile. The movable belt arrangement is moved through a signature engaging section with the cyclical velocity profile causing the motor to decelerate the movable belt arrangement from a first speed to a second speed while engaging a signature in the signature engaging section. The signature enters the signature engaging section at the first speed, and leaves the signature engaging section at the second speed, lower than the first speed. The cyclical velocity profile causes the movable belt arrangement to accelerate upon the signature leaving the signature engaging section, back to the first speed, prior to a next signature entering the signature engaging section.

14 Claims, 7 Drawing Sheets

SIGNATURE VELOCITY REDUCTION DEVICE AND METHOD

BACKGROUND OF THE INVENTION

In a printing operation, signatures are moved through a printing press at a maximum press speed that is considerably faster than can be accommodated in downstream equipment such as folders. Typically, signature speed is reduced by approximately 50% before input to a folder.

In known printing press equipment, a deceleration mechanism is utilized to decelerate signatures as they exit a printing press, and prior to input to a folder. The deceleration mechanism implements mechanical structures that engage and decelerate the individual signatures. The constant stress of multiple decelerations of substantial numbers of signatures, as are encountered in commercial printing operations, causes durability problems with known deceleration solutions. Moreover, in some known devices, the abrupt nature of the signature deceleration results in product defects.

SUMMARY OF THE INVENTION

The present invention provides a new and improved apparatus and method for decelerating a signature.

In a first exemplary embodiment of the present invention, an apparatus for decelerating a signature comprises a movable belt arrangement, and a motor coupled to the movable belt arrangement for controllably moving the movable belt arrangement through a cyclical velocity profile. Pursuant to a feature of the present invention, the movable belt arrangement is moved through a signature engaging section with the cyclical velocity profile causing the motor to decelerate the movable belt arrangement from a first speed to a second speed while engaging a signature in the signature engaging section. The signature enters the signature engaging section at the first speed, and leaves the signature engaging section at the second speed, lower than the first speed. The cyclical velocity profile causes the movable belt arrangement to accelerate upon the signature leaving the signature engaging section, back to the first speed, prior to a next signature entering the signature engaging section.

In a second exemplary embodiment of the present invention, a method for decelerating a signature comprises the steps of providing a movable belt arrangement, and controllably moving the movable belt arrangement through a cyclical velocity profile. Pursuant to a feature of the present invention, the cyclical velocity profile causes the movable belt arrangement to decelerate from a first speed to a second speed while engaging a signature in a signature engaging section, the signature entering the signature engaging section at the first speed, and leaving the signature engaging section at the second speed, lower than the first speed. The cyclical velocity profile subsequently accelerates the movable belt arrangement upon the signature leaving the signature engaging section, back to the first speed, prior to a next signature entering the signature engaging section.

DETAILED DESCRIPTION OF THE PREFERRED EMBODIMENTS

Figure 1:
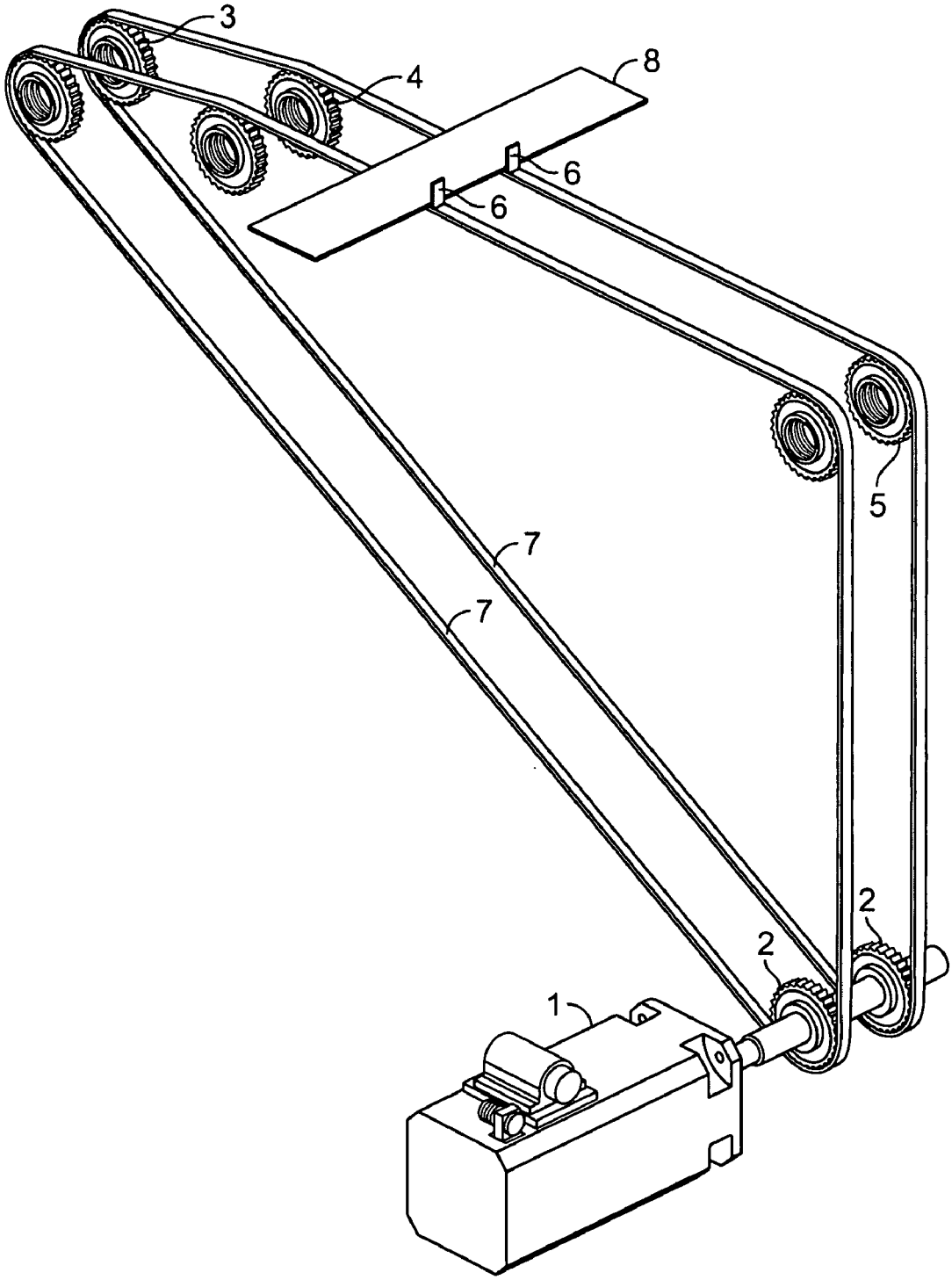
FIG. 1 is a perspective view of a motor driven belt arrangement used as a signature deceleration mechanism, according to a feature of the present invention.

Referring now to the drawings, and initially to FIG. 1, there is shown a perspective view of a motor driven movable belt arrangement used as a signature deceleration mechanism, according to a feature of the present invention. A variable speed motor 1 is coupled to a drive sprocket assembly 2. A pair of belts 7 is arranged to extend around the drive sprocket assembly 2 for circulation through a path defined by the drive sprocket assembly 2 and idler sprockets 3, 4, 5. A pair of pins 6 is provided, each one of the pair 6 is mounted on a respective one of the belts 7 to register and align a signature 8 carried by the belts 7 from the idler sprockets 3 to the idler sprockets 5.

Figure 1A:
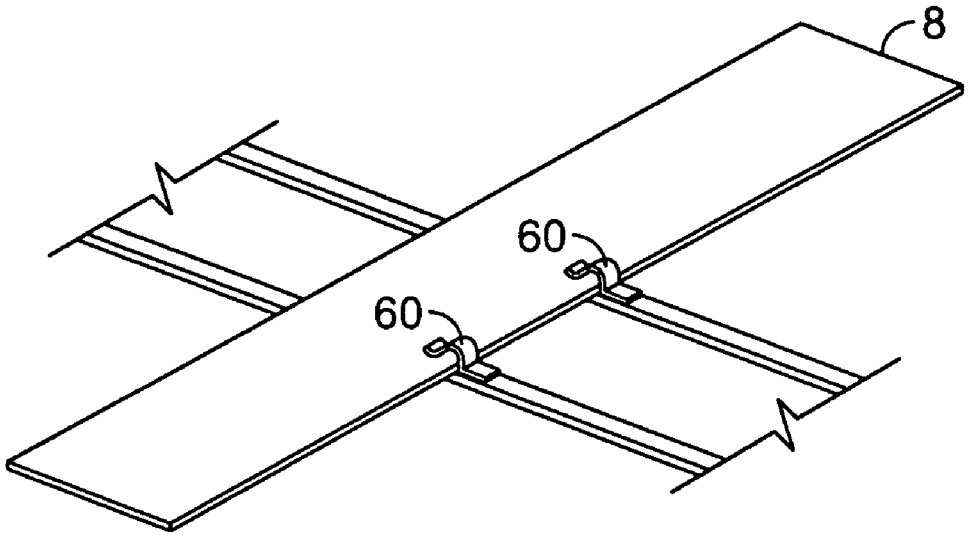
FIG. 1*a* is a segment of the perspective view of FIG. 1, showing a gripper embodiment of the present invention.

FIG. 1*a* shows an alternative embodiment for the pins of FIG. 1. In the embodiment of FIG. 1*a*, the structure arranged to register and align the signature 8 comprises a pair of grippers 60.

Figure 1B:
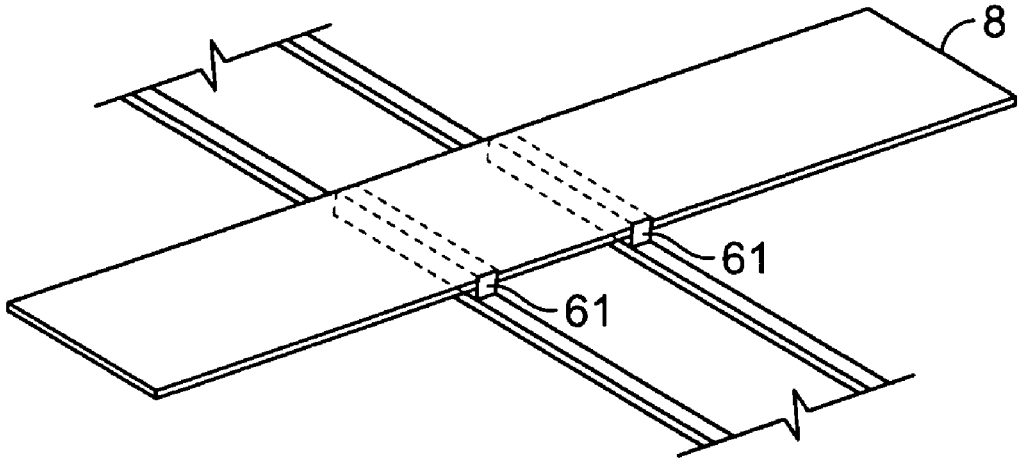
FIG. 1*b* is a segment of the perspective view of FIG. 1, showing a pad embodiment of the present invention.

FIG. 1*b* shows a further alternative embodiment for the pins of FIG. 1. In the embodiment of FIG. 1*b*, the structure arranged to register and align the signature 8 comprises a pair of pads 61.

Figure 3:
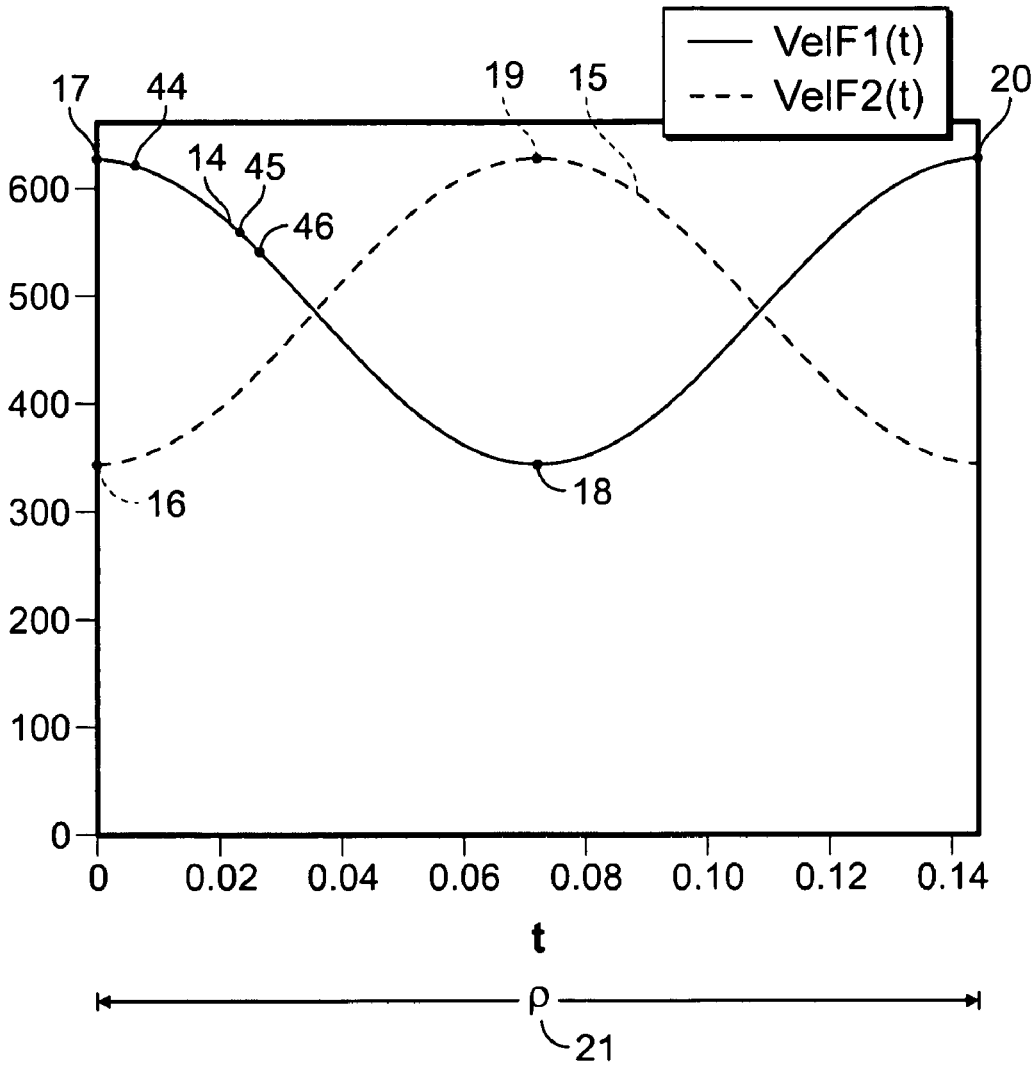
FIG. 3 is a graph showing motor velocity profiles for the belt arrangements of FIGS. 1 and 2.

According to a feature of the present invention, the variable speed motor 1 is controlled to operate in a sinusoidal speed variation cycle, as illustrated, for example, by the solid line velocity profile curve 14 depicted in FIG. 3. The speed of the motor 1 is at a maximum when the pins 6 are at a predetermined distance downstream from the idler sprockets 3, and first contact an incoming signature 8 moving at a high printing press speed (point 17 on the graph of FIG. 3). The speed of the motor 1 is controlled to continuously decelerate (points 17 to 18 on the graph of FIG. 3), until the belts 7 are moved to displace the signature 8 from the idler sprockets 3 to the idler sprockets 5, for discharge of the signature 8 to a downstream piece of equipment.

At point 18, the speed of the motor 1 is at a minimum, to match the operating speed of the downstream equipment. After discharge of the signature 8, the speed of the motor 1 is controlled to accelerate back to its maximum speed (points 18 to 20 on the graph of FIG. 3). At point 20, the motor 1 has moved the pins 6 back past the idler sprockets 3, and in a position to receive another signature 8 from the printing press for deceleration.

Figure 2:
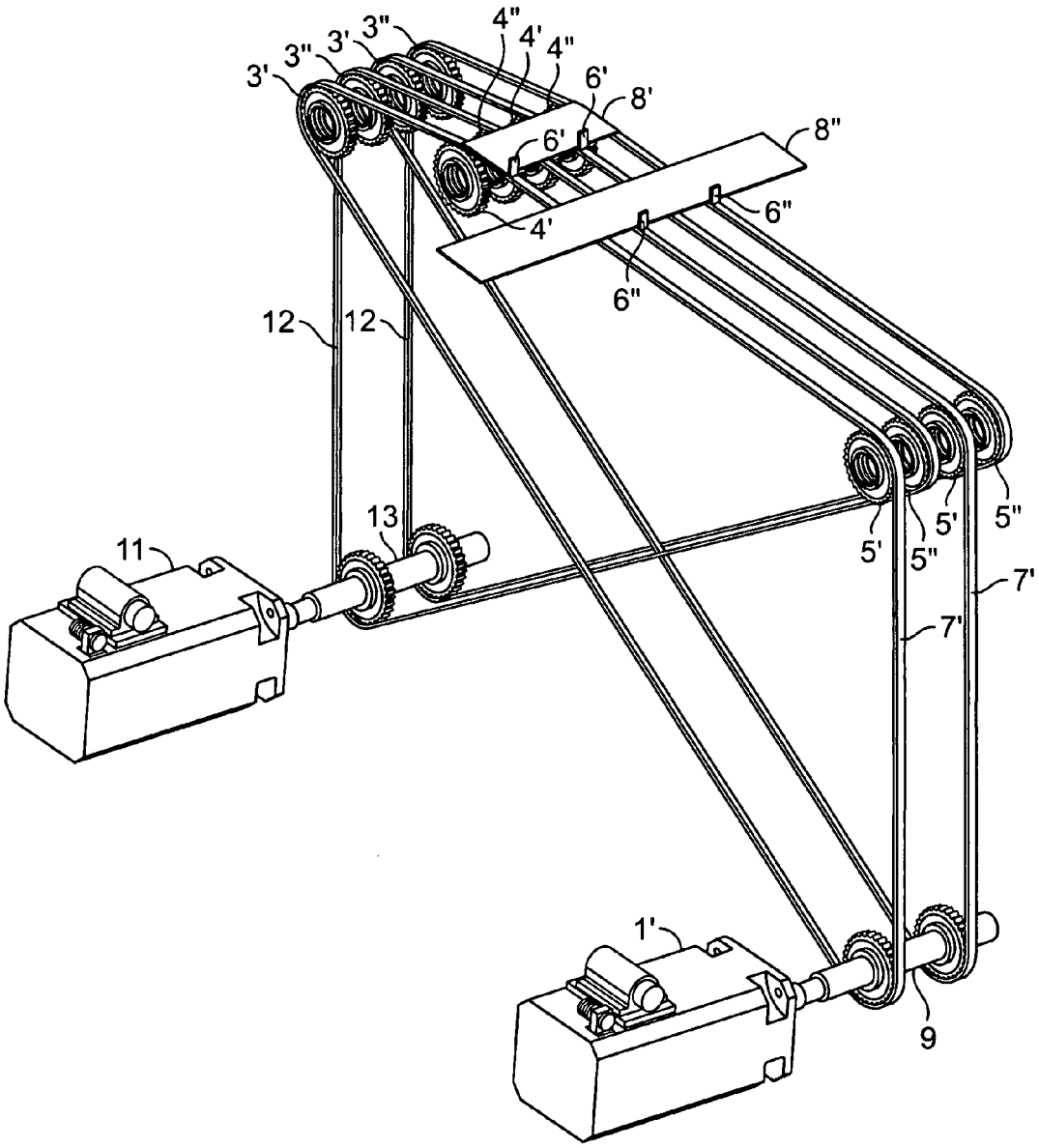
FIG. 2 is a perspective view of a two-motor belt arrangement for a signature deceleration mechanism, according to a feature of the present invention.

Referring now to FIG. 2, there is shown a perspective view of a two-motor movable belt arrangement for a signature deceleration mechanism, according to a feature of the present invention. A first variable speed motor 1' is coupled to a drive sprocket assembly 9. A first pair of belts 7' is arranged to extend around the drive sprocket assembly 9 for circulation through a path defined by the drive sprocket assembly 9 and idler sprockets 3', 4', 5'. A first pair of pins 6' is provided, each one of the pins 6' is mounted on a respective one of the belts 7' to register and align a first signature 8' carried by the belts 7' from the idler sprockets 3' to the idler sprockets 5'.

A second variable speed motor 11 is coupled to a drive sprocket assembly 13. The drive sprocket assembly 13 is arranged to drive a second pair of belts 12 through a path defined by the drive sprocket assembly 13 and the idler sprockets 3", 4", 5". A second pair of pins 6" is provided, each one of the pair 6" is mounted on a respective one of the belts 12 to register and align a second signature 8" carried by the belts 12 from the idler sprockets 3" to the idler sprockets 5". The second pair of belts 12 is offset from and interspersed between the first pair of belts 7' such that the pairs of belts 7' and 12 are moved independently from one another by the respective motors 1, 11.

According to a feature of the present invention, the variable speed motors 1, 11 are controlled to operate in sinusoidal speed variation cycles that are out of phase from one another. As noted above, the solid line velocity profile curve 14 depicted in FIG. 3 represents the velocity profile for the motor 1. The dotted line velocity profile curve 15 depicted in FIG. 3 represents the velocity profile for the motor 11. As clearly illustrated in the graphs of FIG. 3, the velocity profile 14 for the first motor 1 is at a maximum velocity 17 occurring at the same time as the minimum velocity 16 of the velocity profile 15 for the second motor 11.

Similarly, the minimum velocity 18 of the curve 14, for the first motor 1, occurs at the same time as the maximum velocity 19 of the velocity curve 15 for the second motor 11, and so on. The velocity curve 14 returns to a maximum velocity, once again at point 20, at the end of a period P (21 on the graph of FIG. 3). The frequencies of the curves 14, 15 are each twice the frequency of signature entry to the two motor belt arrangement.

Figure 4:
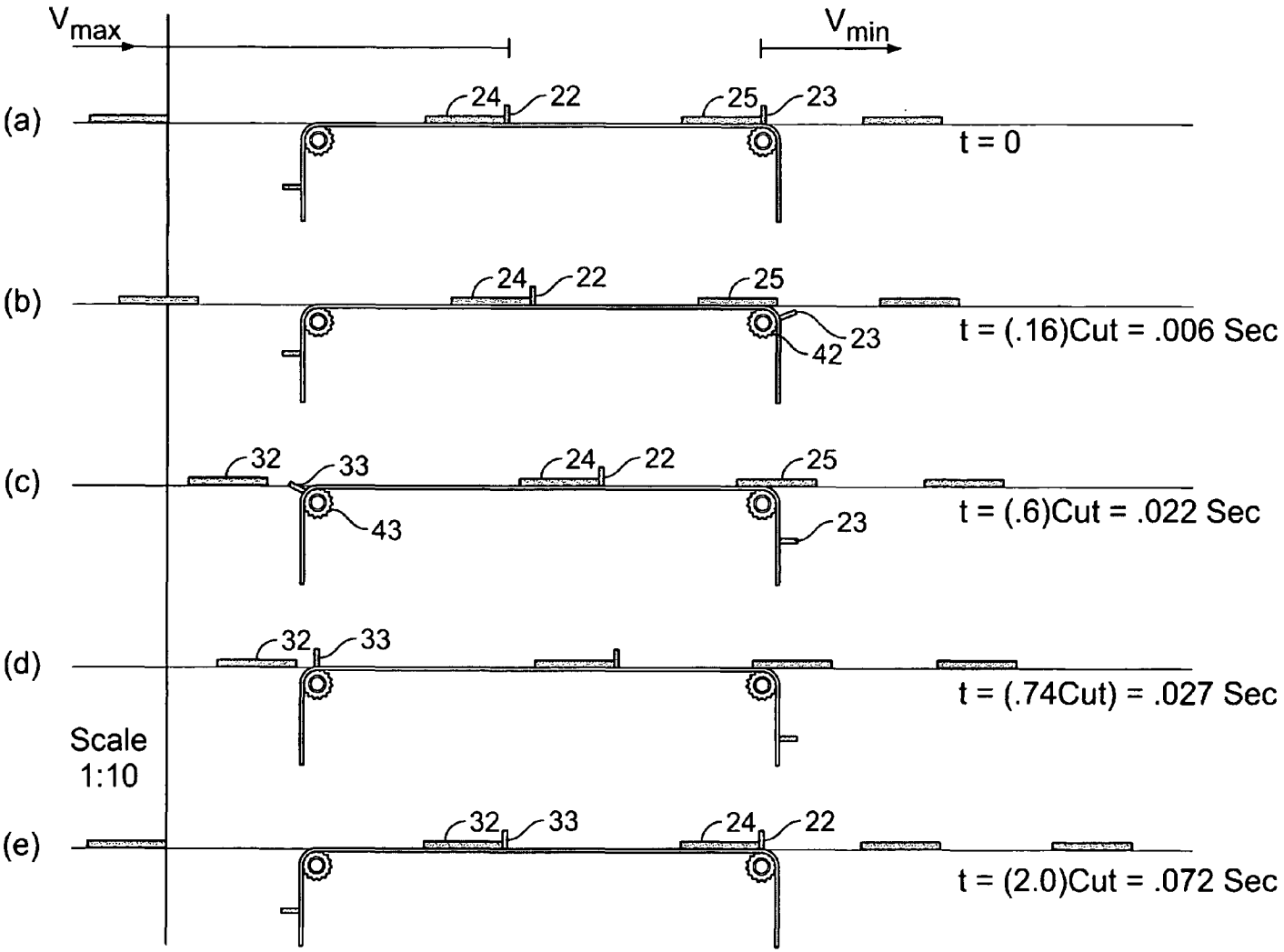
FIGS. 4 (*a*)-(*e*) show a side view progression of signature travel through the two-motor belt arrangement of FIG. 2.

FIGS. 4 (*a*)-(*e*) show a side view progression of signature travel through the two-motor belt arrangement of FIG. 2. FIG. 4(*a*), at time t=0, shows a pin 22 from the first pair of belts 7' when the motor 1 is at the maximum velocity (17 from the graph of FIG. 3). At this time, a signature 24 (at a maximum speed) is entering the belt arrangement, and contacts the pins 22. At the same time, pin 23, of the second pair of belts 12 is at a minimum velocity (16 from the graph of FIG. 3) and the deceleration of the corresponding signature 25 is complete.

FIG. 4(*b*), at time t=0.006 seconds, shows the pin 23 of the second belt pair 12 rotating around idler sprocket 42 (at point 44 of FIG. 3), out of the path of the signature 25. The second belt pair 12 is then in an accelerating mode to move the pin 23 back toward the input end of the two belt system. At this point in the progression, the pin 22 of the first belt pair 7' is acting to decelerate the signature 24.

In FIG. 4(*c*), at time t=0.022 seconds, there is depicted the state of the two belt system of FIG. 2 at point 45 of the graph of FIG. 3. A next pin 33 on the accelerating second belt pair 12 rotates around idler sprocket 43, into the path of a next incoming signature 32, while the pin 22 of the first belt pair 7' continues to decelerate the corresponding signature 24. The signature 25, previously abutting the pin 23 in FIG. 4(*b*), is transported away from the two belt system, at a fully decelerated speed. Meanwhile, the pin 23 of the second belt pair 12 continues to be accelerated by the motor 11.

In FIG. 4(*d*), at point 46 of the graph of FIG. 3, the pin 33 of the second pair of belts 12, is positioned ahead of the incoming signature 32.

Finally, in FIG. 4(*e*), the second pair of belts 12 continues to be accelerated until the pin 33 has engaged the signature 32 (point 19 of the graph of FIG. 3). Thereafter, the second belt pair 12 starts to decelerate. At the same time, the first pair of belts 7' is fully decelerated (point 18 of the graph of FIG. 3), as is the corresponding pin 22 and signature 24.

This sequence of events continues such that alternative signatures, each at a maximum speed, are engaged by pins, alternatively, of the first and second pairs of belts 7' and 12. The belt pairs operate through alternate periods of acceleration and deceleration, 180 degrees out of phase from one another, the decelerate each of the incoming signatures, from a press speed to a slower speed suitable for operation of downstream equipment.

Figure 5:
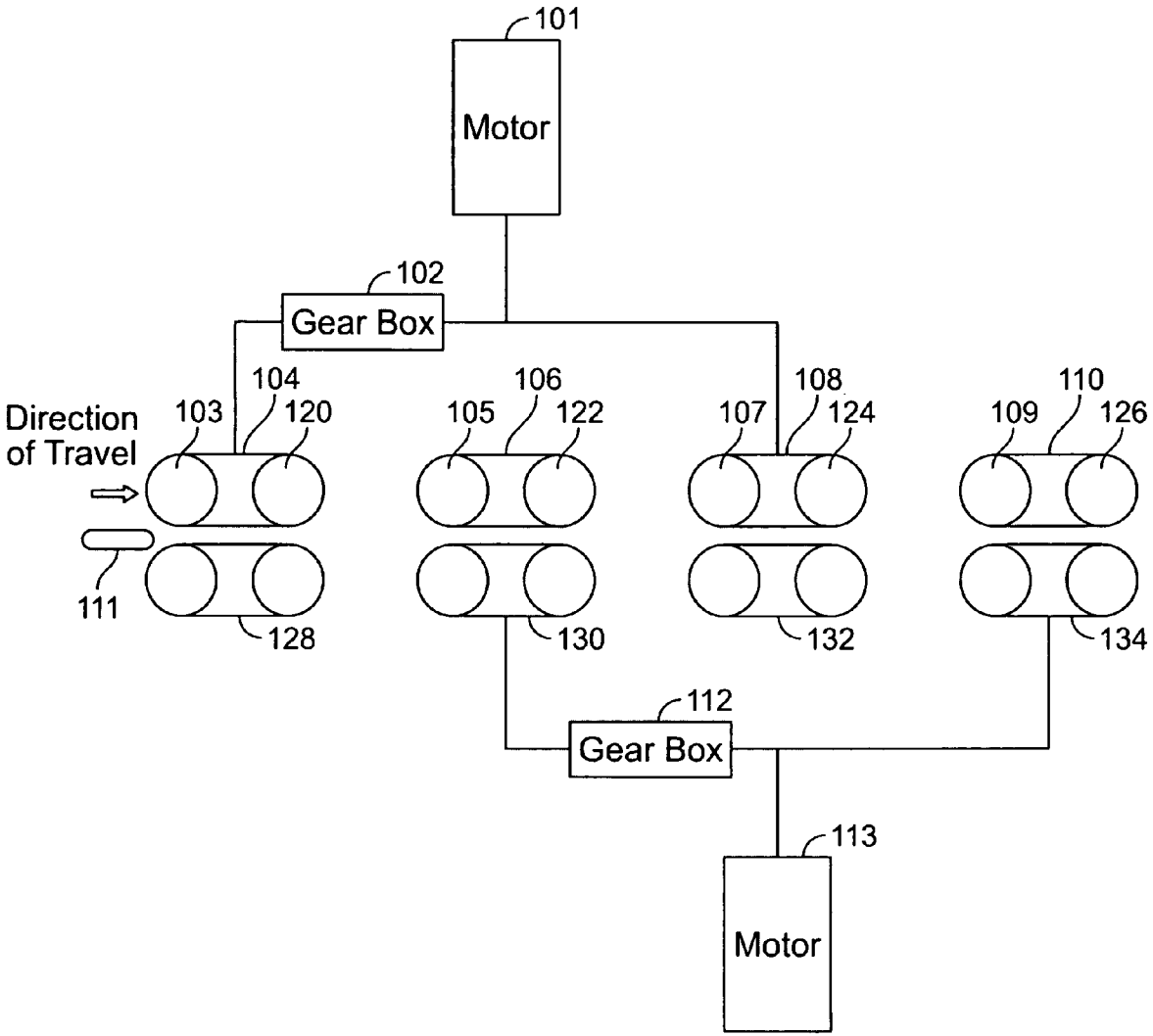
FIG. 5 is a schematic illustration of a multi-stage signature deceleration arrangement, according to a feature of the present invention.

Referring now to FIG. 5, there is shown a schematic illustration of a multi-stage signature deceleration arrangement, according to another feature of the present invention. The solution provided by the arrangement of FIG. 5 comprises a sequence of velocity reduction belt arrangements, each operating according to a cyclical velocity profile, to reduce the speed of each signature in stages, as the signatures travel through the sequence of belts. As each signature traverses each stage it is decelerated by a predetermined amount in each stage.

In the example of FIG. 5 there is shown a four stage deceleration arrangement including drive cylinders 103, 105, 107 109. A first motor 101 is coupled to each of a gear box 102 and the drive cylinder 107. The gear box 102 is, in turn, coupled to the drive cylinder 103. The gear ratio provided by the gear box 102 is such that the surface velocity of the drive cylinder 103 is proportionately faster than the surface velocity of the drive cylinder 107, as will be described in greater detail below.

A second motor 113 is coupled to each of a gear box 112 and the drive cylinder 109. The gear box 112 is, in turn, coupled to the drive cylinder 105. The gear ratio provided by the gear box 112 is such that the surface velocity of the drive cylinder 105 is proportionately faster than the surface velocity of the drive cylinder 109, as will also be described in greater detail below.

Each of the drive gears 103, 105, 107, 109 dives a corresponding endless belt 104, 106, 108, 110 around respective idler cylinders 120, 122, 124, 126. Moreover, a plurality of idler belt arrangements 128, 130, 132, 134 is arranged, one each in an opposed relation to a corresponding one of the endless belt 104, 106, 108, 110. A signature 111 is received between the pairs of opposed endless belts 104, 106, 108, 110 and idler belt arrangements 128, 130, 132, 134, for transport in the direction of travel indicated in FIG. 5, and gradual deceleration from belt to belt.

Figure 6:
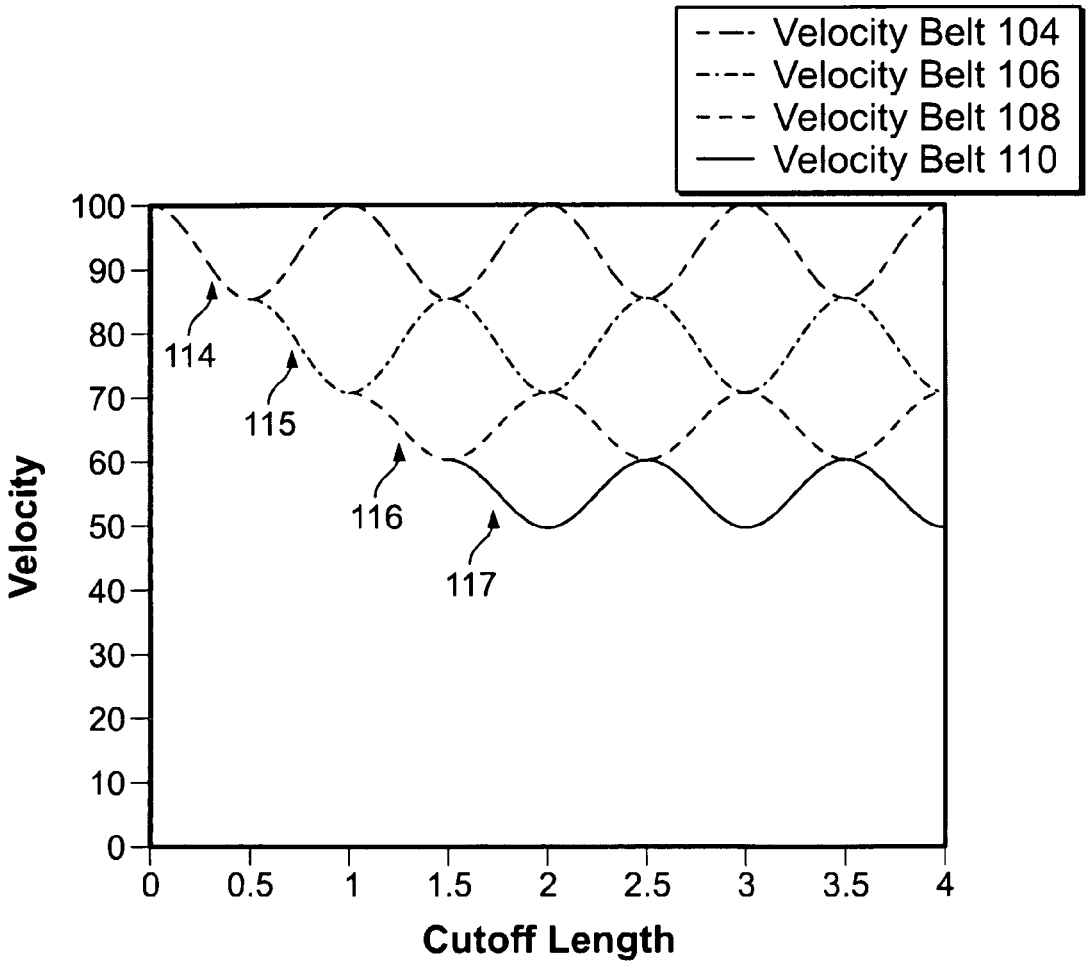
FIG. 6 is a graph showing motor velocity profiles for the multi-stage signature deceleration arrangement of FIG. 5.

FIG. 6 is a graph showing motor velocity profiles 114, 115, 116, 117, for the multi-stage signature deceleration arrangement of FIG. 5. The velocity profiles 114, 115, 116, 117 correspond to the velocities of the belts 104, 106, 108, 110, respectively, as they are driven by the respective motors 101, 113. The motors 101, 113 are each controlled to be operated through a sinusoidal velocity cycle and the motors 101, 113 are operated 180 degrees out of phase from one another.

As the signature 111 exits the opposed belts 104, 128 it will be traveling at 85.4% of the entrance velocity as the signature 111 follows the velocity profile 114. The signature then enters the opposed belts 106, 130 and follows the velocity profile 115. The opposed belts 106, 130 operate to decelerate the signature further from 85.4% of the original entrance velocity, to 70.7% of the entrance velocity.

As the signature 111 travels through the opposed belts 106, 130, the belt 104 is driven to accelerate back to 100% velocity (velocity profile 114) to match the entrance velocity of a next entering signature. After travel through the opposed belts 106, 130, the signature 111 enters the opposed belts 108, 132, and decelerates from 70.7% to 60.4% of the entrance velocity, according to the velocity profile 116. Finally, the signature 111 travels through the opposed belts 110, 134 according to velocity profile 117 to further reduce the velocity to 50% of the entrance velocity. Thus, the signature velocity is incrementally reduced 50% in four stages.

Subsequent to transport of a signature, each of the driven belts 106, 108, 110 is accelerated back to the initial velocity to match the velocity of a next incoming signature. The velocity profiles 114, 116 are in phase with one another, with an offset in nominal velocity. The offset is achieved by the gearbox 102 in between the motor 101 and the driven cylinder 103. The velocity profiles 115, 117 are also in phase, but offset in nominal velocity by the gear box 112.

As noted above, the motors 101, 113 101, 113 are each controlled to be operated through a sinusoidal velocity cycle and the motors 101, 113 are operated 180 degrees out of phase from one another. Additional stages can be added with either additional motors or gearboxes.

In the preceding specification, the invention has been described with reference to specific exemplary embodiments and examples thereof. It will, however, be evident that various modifications and changes may be made thereto without departing from the broader spirit and scope of the invention as set forth in the claims that follow. The specification and drawings are accordingly to be regarded in an illustrative manner rather than a restrictive sense.

What is claimed is:

1. An apparatus for decelerating a signature comprising:

a movable belt arrangement; and means for driving the movable belt arrangement for controllably moving the movable belt arrangement through a cyclical velocity profile, the profile including a continuously oscillating sinusoidal wave;

the movable belt arrangement moving a signature through a signature engaging section;

the cyclical velocity profile causing the motor to decelerate the movable belt arrangement from a first speed to a second speed while engaging the signature in the signature engaging section, the signature entering the signature engaging section at the first speed, and leaving the signature engaging section at the second speed, lower than the first speed, and to accelerate the movable belt arrangement upon the signature leaving the signature engaging section, back to the first speed, prior to a next signature entering the signature engaging section.

2. The apparatus of claim 1 further comprising signature engaging pins arranged on the movable belt arrangement.

3. The apparatus of claim 1 wherein the movable belt arrangement comprises a pair of endless belts extended around sprockets.

4. The apparatus of claim 1 wherein the second speed is 50% of the first speed.

5. The apparatus of claim 1 wherein the movable belt arrangement comprises a sequence of movable belts arranged and configured to transport signatures, one after another, in a series of stages, each one of the sequence of movable belts decelerating the signatures by a preselected amount.

6. The apparatus of claim 5, wherein the means for driving comprises first and second means for driving each selectively coupled to alternate ones of the sequence of movable belts, the first and second means for driving operating according to the cyclical velocity profile, out of phase from one another.

7. The apparatus of claim 6 wherein the first means for driving is directly coupled to a first one of the alternate ones of the sequence of movable belts, and coupled through a first gearbox to a second one of the alternate ones of the sequence of movable belts, and the second means for driving is directly coupled to a third one of the alternate ones of the sequence of movable belts, and coupled through a second gearbox to a fourth one of the alternate ones of the sequence of movable belts.

8. The apparatus of claim 7 wherein the first gearbox and the second gearbox operate to provide a nominal velocity offset between the first one and the second one, and the third one and the fourth one of the alternate ones of the sequence of movable belts, respectively.

9. The apparatus of claim 1 further comprising signature engaging grippers arranged on the movable belt arrangement.

10. The apparatus of claim 1 further comprising signature engaging pads arranged on the movable belt arrangement.

11. An apparatus for decelerating signatures comprising:

a movable belt arrangement including a first movable belt arrangement interspersed with a second movable belt arrangement; and a first means for driving and a second means for driving the first and second movable belt arrangements respectively, for controllably moving the first and second belt arrangements through first and second cyclical velocity profiles, the first cyclical velocity profile of the first means for driving being out of phase from the second cyclical velocity profile of the second means for driving;

the movable belt arrangement moving the signatures through a signature engaging section;

the first and second cyclical velocity profiles causing the first and second means for driving to decelerate a respective one of the first and second movable belt arrangements from a first speed to a second speed while engaging a signature in the signature engaging section, the signature entering the signature engaging section at the first speed, and leaving the signature engaging section at the second speed, lower than the first speed, and to accelerate the respective one of the first and second movable belt arrangements upon the signature leaving the signature engaging section, back to the first speed, prior to a next signature entering the signature engaging section that is to be engaged by the respective one of the first and second movable belt arrangements.

12. The apparatus of claim 11 wherein the first cyclical velocity profile is 180 degrees out of phase from the second cyclical velocity profile.

13. A method for decelerating a signature comprising the steps of:

providing a movable belt arrangement;

controllably moving the movable belt arrangement through a cyclical velocity profile, the profile including a continuously oscillating sinusoidal wave;

causing the cyclical velocity profile to decelerate the movable belt arrangement from a first speed to a second speed while the movable belt arrangement engages the signature in a signature engaging section, the signature entering the signature engaging section at the first speed, and leaving the signature engaging section at the second speed, lower than the first speed; and accelerating the movable belt arrangement upon the signature leaving the signature engaging section, back to the first speed, prior to a next signature entering the signature engaging section.

14. A method for decelerating signatures comprising the steps of:

providing a first and a second movable belt arrangement;

controllably moving the first and the second movable belt arrangements through a first and a second cyclical velocity profile, respectively, the cyclical velocity profiles including a continuously oscillating sinusoidal wave;

causing the first and the second cyclical velocity profile to decelerate the first and the second movable belt arrangements, respectively, from a first speed to a second speed while the first and second movable belt arrangements engage a signature in a signature engaging section, the signature entering the signature engaging section at the first speed, and leaving the signature engaging section at the second speed, lower than the first speed; and accelerating the respective one of the first and second movable belt arrangements upon the signature leaving the signature engaging section, back to the first speed, prior to a next signature entering the signature engaging section that is to be engaged by the respective one of the first and second movable belt arrangements.

* * * * *